US007478733B2

(12) United States Patent
Hsu

(10) Patent No.: US 7,478,733 B2
(45) Date of Patent: Jan. 20, 2009

(54) BABY BOTTLE WITH AN AIR VALVE DEVICE

(75) Inventor: Shen-Kwang Hsu, Taipei (TW)

(73) Assignee: Heinz Baby Corporation, Taipei (TW)

( * ) Notice: Subject to any disclaimer, the term of this patent is extended or adjusted under 35 U.S.C. 154(b) by 262 days.

(21) Appl. No.: 11/332,166

(22) Filed: Jan. 17, 2006

(65) Prior Publication Data

US 2007/0163983 A1 Jul. 19, 2007

(51) Int. Cl.
*A61J 11/00* (2006.01)
*A61J 9/00* (2006.01)

(52) U.S. Cl. ..... 215/11.1; 215/11.4

(58) Field of Classification Search ..... 215/11.1, 215/11.4, 11.5; 137/433, 434; 220/714
See application file for complete search history.

(56) References Cited

U.S. PATENT DOCUMENTS 812,451 A * 2/1906 Rice ..... 137/202
1,732,126 A * 10/1929 Gardner ..... 215/11.5
1,999,619 A * 4/1935 Reese et al. ..... 215/11.5
2,107,442 A * 2/1938 Hughes ..... 215/11.4
2,328,701 A * 9/1943 Woodrum ..... 4/398
2,722,217 A * 11/1955 Rose-Miller ..... 215/11.4
2,787,376 A * 4/1957 Coulson ..... 210/119
3,044,650 A * 7/1962 Oltion et al. ..... 215/11.1
3,059,797 A * 10/1962 Wilkinson et al. ..... 215/11.1
4,401,224 A * 8/1983 Alonso ..... 215/11.5
5,234,414 A * 8/1993 Hung ..... 604/254
5,607,074 A * 3/1997 De Gennaro ..... 215/11.5
7,204,380 B2 * 4/2007 Webb et al. ..... 215/11.4

* cited by examiner

*Primary Examiner*—Sue A Weaver
(74) *Attorney, Agent, or Firm*—Muncy, Geissler, Olds & Lowe, PLLC

(57) ABSTRACT

A baby bottle with an air valve device has a bottle, an air valve device and a cap. The bottle has a mouth. The air valve device is a check valve and has a valve seat mounted on the mouth of the bottle and having at least one through hole, a valve stem and a valve disk. The valve seat has at least one through hole. The valve stem is mounted slidably through the valve seat and has a bottom end. The valve disk is attached to the bottom end of the valve stem and has an air chamber and an annular disk. The air chamber is hollow and has a proximal end attached to the bottom end of the valve stem. The annular disk is formed around and protrudes out from the proximal end of the air chamber and selectively closes the through hole in the valve seat.

5 Claims, 4 Drawing Sheets

BABY BOTTLE WITH AN AIR VALVE DEVICE

BACKGROUND OF THE INVENTION

1. Field of the Invention

The present invention relates to a baby bottle, especially to a baby bottle with an air valve device.

2. Description of Related Art

Infants often ingest air from their baby bottles when feeding, which sometimes results in digestive tract discomfort and irritation. For example, infants may ingest an inordinate amount of air when they continue to suck on an empty baby bottle.

Baby bottles currently available either are not equipped with devices to keep infants from swallowing air in baby bottles and the problems previously described occur.

To overcome the shortcomings, the present invention provides a baby bottle with an air valve device to mitigate or obviate the aforementioned problems.

SUMMARY OF THE INVENTION

The main objective of the invention is to provide a baby bottle with an air valve device that keeps a baby from ingesting air in the baby bottle and comprises a bottle, an air valve device and a cap.

The bottle has a mouth.

The air valve device is a check valve, is mounted in the mouth of the bottle and comprises a valve seat, a valve stem and a valve disk.

The valve seat is mounted on the mouth of the bottle and has at least one through hole formed through the valve seat.

The valve stem is mounted slidably through the valve seat and has a top end, a bottom end and a head. The head is formed on the top end of the valve stem and keeps the valve stem from going into the bottle.

The valve disk is attached to the bottom end of the valve stem and has an air chamber and an annular disk. The air chamber is hollow and has a proximal end attached to the bottom end of the valve stem. The annular disk is formed around and protrudes out from the proximal end of the air chamber and selectively closes the at least one through hole in the valve seat.

Other objectives, advantages and novel features of the invention will become more apparent from the following detailed description when taken in conjunction with the accompanying drawings.

DETAILED DESCRIPTION OF PREFERRED EMBODIMENT

Figure 1:
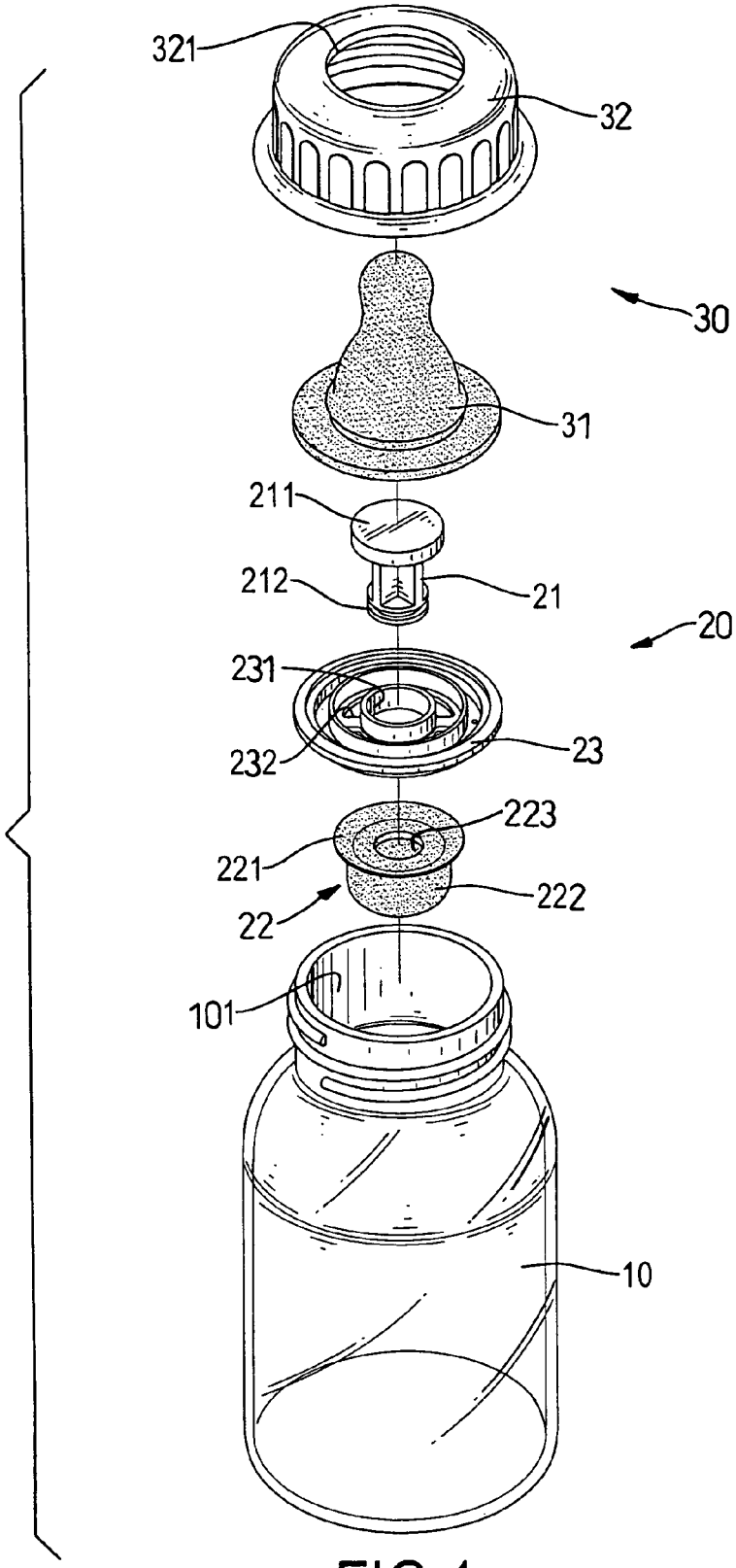
FIG. 1 is an exploded perspective view of a baby bottle with an air valve device in accordance with the present invention.

With reference to FIG. 1, a baby bottle with an air valve device in accordance with the present invention keeps infants from ingesting air in the baby bottle and comprises a bottle (10), an air valve device (20) and a cap (30).

The bottle (10) holds a liquid and has a top and a mouth (101). The mouth (101) is formed in the top of the bottle (10).

The air valve device (20) is a check valve, is mounted in the mouth (101) of the bottle (10) and comprises a valve seat (23), a valve stem (21) and a valve disk (22)

Figure 2:
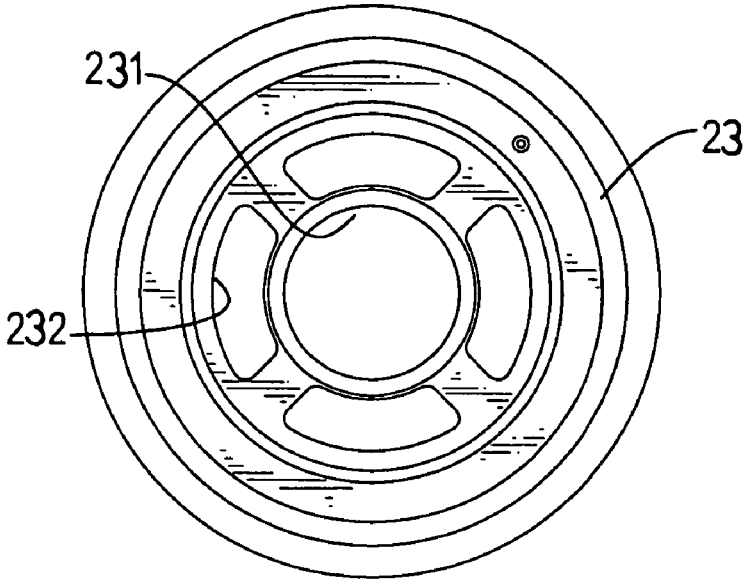
FIG. 2 is a top view of a first embodiment of a valve seat for the baby bottle in FIG. 1.
Figure 3:
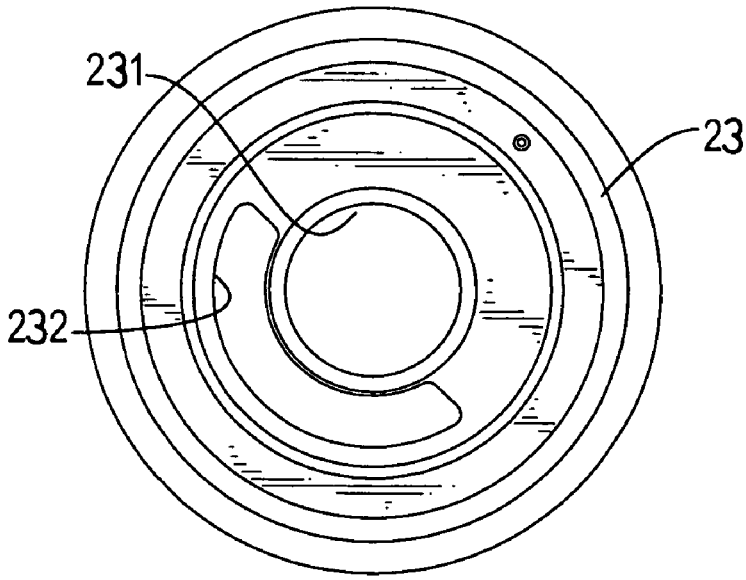
FIG. 3 is a top view of a second embodiment of a valve seat for the baby bottle in FIG. 1.

The valve seat (23) is mounted on the mouth (101) of the bottle (10) and has a center, a stem hole (231) and at least one through hole (232). The stem hole (231) is formed through the center of the valve seat (23). With further reference to FIGS. 2 and 3, the at least one through hole (232) is formed through the valve seat (23) around the stem hole (231) and may be one curved segment or two, three, four or more elongated curved holes equally spaced around the stem hole (231).

The valve stem (21) is mounted slidably in the stem hole (231) and has a top end, a bottom end and a head (211). The bottom end has an annular slot (212). The head (211) is larger than the stem hole (231), is formed on the top end of the valve stem (21) and keeps the valve stem (21) from going into the bottle (10).

Figure 4:
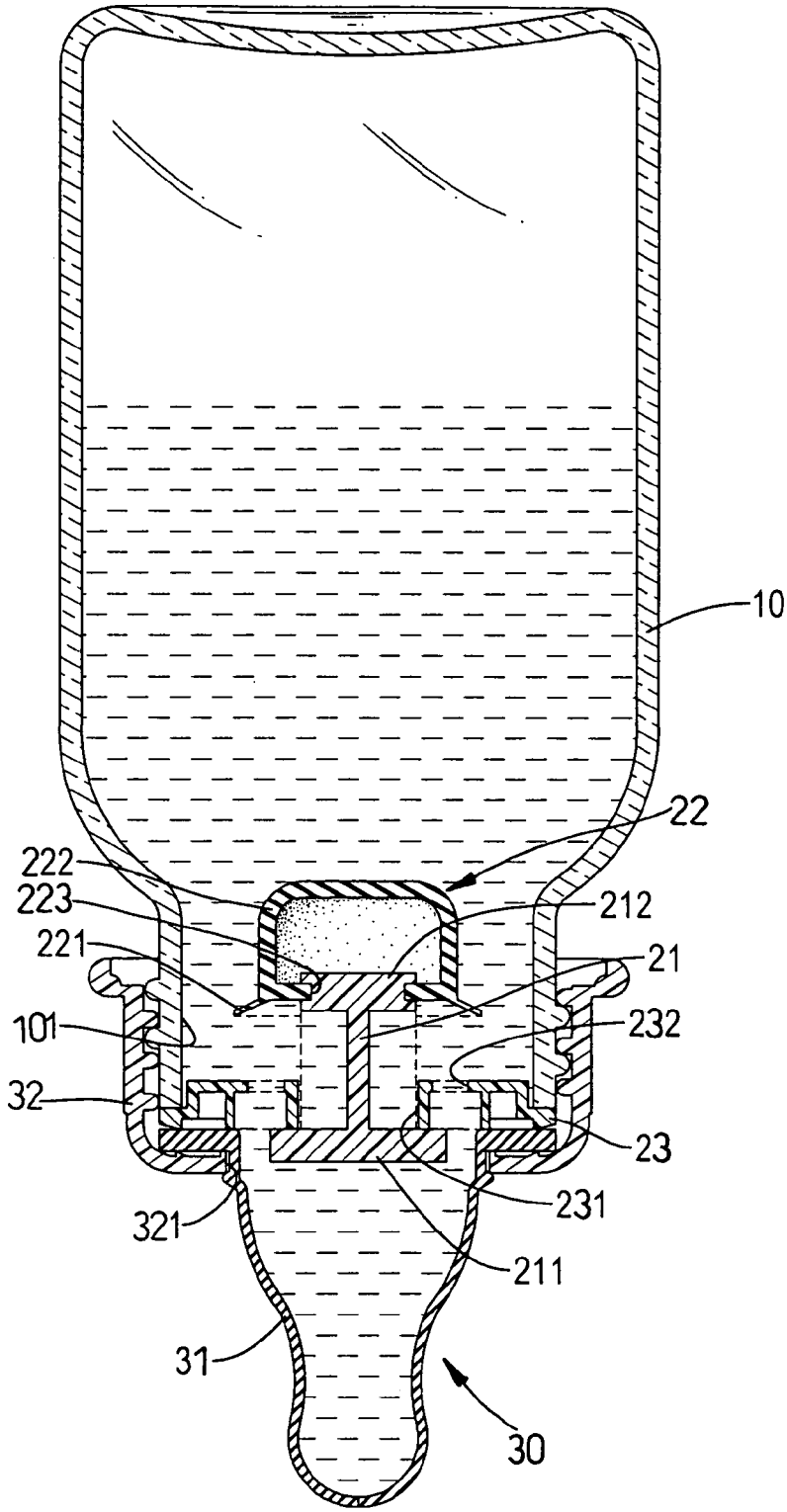
FIG. 4 is an operational cross sectional side view of the baby bottle in FIG. 1 with the valve device open.
Figure 5:
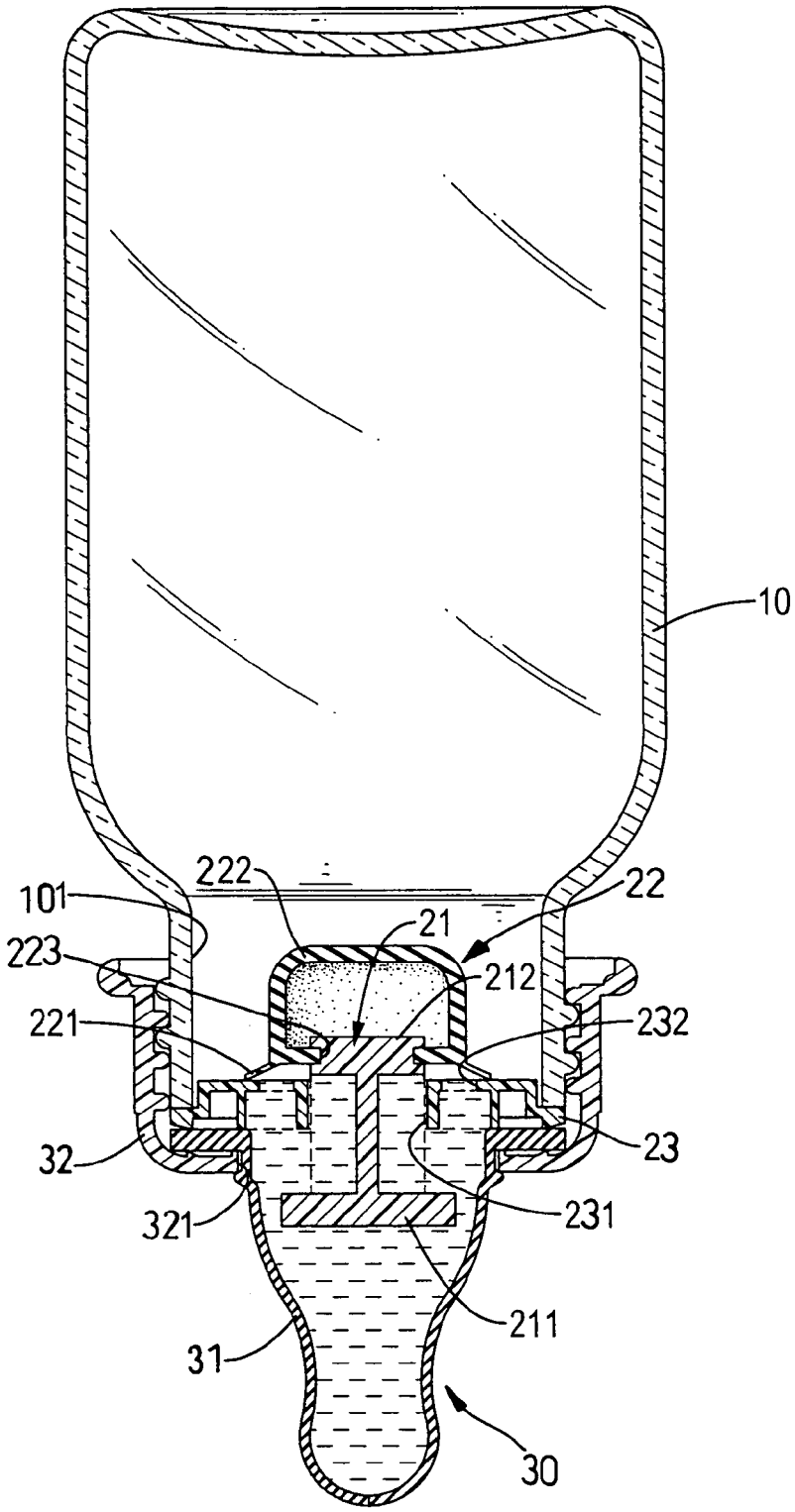
FIG. 5 is an operational cross sectional side view of the baby bottle in FIG. 1 with the valve device closed.

The valve disk (22) is hollow, is attached to the bottom end of the valve stem (21) and has an air chamber (222) and an annular disk (221). The air chamber (222) is attached to the bottom end of the valve stem (21) and has a proximal end, a distal end and a mounting hole (223). The mounting hole (223) is formed through the proximal end of the air chamber (222) and is mounted in the annular slot (212) at the bottom end of the valve stem (21). With further reference to FIGS. 4 and 5, the annular disk (221) is formed around and protrudes out from the proximal end of the air chamber (222) and selectively closes the at least one through hole (232) in the valve seat (23).

The cap (30) is attached to the top of the bottle (10), closes the mouth (101) and comprises a nipple (31) and a collar (32). The nipple is mounted on the valve seat (23). The collar (32) is attached to the top of the bottle (10), holds the nipple (31) and valve seat (23) in place and has a central through hole (321). The central through hole (321) allows the nipple (31) to protrude from the bottle (10) through the collar (32).

When the bottle (10) contains a liquid and is inverted to feed a baby, the air chamber (222) floats upward and pulls the annular disk (221) away from the at least one through hole (232) in the valve seat (23). When the baby empties the bottle (10), the annular disk (221) closes the at least one through hole (232) and keeps the baby from ingesting air in the bottle (10).

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A baby bottle comprising a bottle for holding a liquid and having a top; and a mouth formed on the top of the bottle;

an air valve device mounted in the mouth of the bottle and comprising a valve seat mounted on the mouth of the bottle and having a center;

a stem hole formed through the center of the valve seat; and at least one through hole formed through the valve seat around the stem hole;

a valve stem mounted slidably in the stem hole and having a top end;

a bottom end having an annular slot; and a head being larger than the stem hole, formed on the top end of the valve stem for keeping the valve stem from going into the bottle; and a valve disk being hollow, attached to the bottom end of the valve stem and having an air chamber attached to the bottom end of the valve stem and having a proximal end;

a distal end; and a mounting hole formed through the proximal end of the air chamber and mounted in the annular slot at the bottom end of the valve stem; and an annular disk formed around and protruding out from the proximal end of the air chamber to selectively close the at least one through hole in the valve seat; and a cap attached to the top of the bottle, for closing the mouth and comprising a nipple mounted on the valve seat; and a collar attached to the top of the bottle to hold the nipple and valve seat in place and having a central through hole for allowing the nipple to protrude from the bottle through the collar.

2. The baby bottle as claimed in claim 1, wherein the at least one through hole in the valve seat is one curved segment.

3. The baby bottle as claimed in claim 1, wherein the at least one through hole in the valve seat is two elongated curved holes equally spaced around the stem hole.

4. The baby bottle as claimed in claim 1, wherein the at least one through hole in the valve seat is three elongated curved holes equally spaced around the stem hole.

5. The baby bottle as claimed in claim 1, wherein the at least one through hole in the valve seat is four elongated curved holes equally spaced around the stem hole.

* * * * *